United States Patent [19]

Sutou

[11] Patent Number: 4,857,963

[45] Date of Patent: Aug. 15, 1989

[54] IMAGE FORMING APPARATUS

[75] Inventor: Masatoki Sutou, Osaka, Japan

[73] Assignee: Minolta Camera Kabushiki Kaisha, Osaka, Japan

[21] Appl. No.: 139,749

[22] Filed: Dec. 30, 1987

[30] Foreign Application Priority Data

Jan. 9, 1987 [JP] Japan ..... 62-3801

[51] Int. Cl.[4] ..... G03G 15/00

[52] U.S. Cl. ..... 355/321; 355/323

[58] Field of Search ..... 355/3 SH, 14 SH, 14 R, 355/24, 26; 271/3.1, 9, 186

[56] References Cited

U.S. PATENT DOCUMENTS

| | | | |
|---|---|---|---|
| 4,136,862 | 1/1979 | Kunz et al. | 271/186 |
| 4,641,954 | 2/1987 | Miyata et al. | 355/14 R |
| 4,655,131 | 4/1987 | Krämer | 271/3.1 X |
| 4,673,279 | 6/1987 | Brown | 355/25 X |
| 4,721,381 | 1/1988 | Matsuo | 355/14 R |
| 4,743,945 | 5/1988 | Ito et al. | 355/3 SH X |
| 4,748,470 | 5/1988 | Ibuchi | 355/3 SH X |

FOREIGN PATENT DOCUMENTS

| | | | |
|---|---|---|---|
| 60-2535 | 7/1985 | Japan . | |
| 0230164 | 11/1985 | Japan | 355/3 SH |

*Primary Examiner*—Fred L. Braun
*Assistant Examiner*—Robert Beatty
*Attorney, Agent, or Firm*—Burns, Doane, Swecker & Mathis

[57] ABSTRACT

An image forming apparatus including a main body provided with a section for forming an image on a copy paper, a paper supply section arranged below the main body for supplying the copy paper to the main body and a paper discharge section arranged below the main body for receiving the copy paper on which the image has been formed from the main body. The main body, the paper supply section and the paper discharge section are constituted separately and detachable from each other and are vertically arranged in an overlapped manner. The apparatus has a first conveyer for vertically transporting the copy paper from the paper supply section to the main body and a second conveyer for vertically transporting the copy paper from the main body to the paper discharge section. Therefore, the apparatus occupies the least possible mounting area.

11 Claims, 3 Drawing Sheets

IMAGE FORMING APPARATUS

FIELD OF THE INVENTION

This invention relates generally to improvements in and relating to image forming apparatuses. More specifically, it relates to those which are capable of positioning an optional arrangement in the vertical direction of the machine proper.

BACKGROUND OF THE INVENTION

It is a strong tendency of modern electronic photocopiers to attach optionally one or more sorters, automatic document feeders, paper supply units and the like appliances to the machine proper or main body which has developed a high and amazing efficiency and performance, so as to meet with various user side demands and to provide high performance photocopiers.

It is the general and conventional practice of the art that these sorters and the like optional appliances are provided in a side-by-side arrangement around the machine proper. Therefore, the overall photocopier arrangement requires a large occupying area, so as to meet with the machine proper. Therefore, the overall photocopier arrangement requires a large occupying area, so as to meet with the above demands, thus a considerable reduction of copier-occupied office area is a substantial concern among the users.

SUMMARY OF THE INVENTION

Accordingly, it is a main object of the invention to provide an image forming apparatus occupying the least possible mounting area.

A further object is to provide an improved image forming apparatus providing such an advantageous arrangement that substantially all of the optional attachment block appliances are capable of being grouped into a vertical assembly.

Still a further advantage of the invention is to provide an improved image forming apparatus providing a capability for assembling optional appliances with a large freedom of combination.

The foregoing objects of the invention can be fulfilled by providing such an image forming apparatus which comprises:

a main body provided with a section for forming images on a copy paper;

paper supply means arranged below said main body for supplying the copy paper to said main body;

Paper discharge means arranged below said main body for discharging images formed the copy paper;

first conveyer means for vertically conveying the copy paper from said paper supply means to said main body; and second conveyer means for vertically conveying the copy paper from said main body to said paper discharge means.

BRIEF DESCRIPTION OF THE DRAWINGS

These and other objects and features of the present invention will become apparent from the following description of preferred embodiments thereof taken in conjunction with the accompanying drawings, in which.

In the following description, like parts are designated by like reference numbers throughout the several drawings.

DETAILED DESCRIPTION OF THE PREFERRED EMBODIMENTS

In the following, a preferred embodiment of the invention will be described with reference to the accompanying drawings, more specifically FIGS. 1 and 2 thereof.

Figure 1:
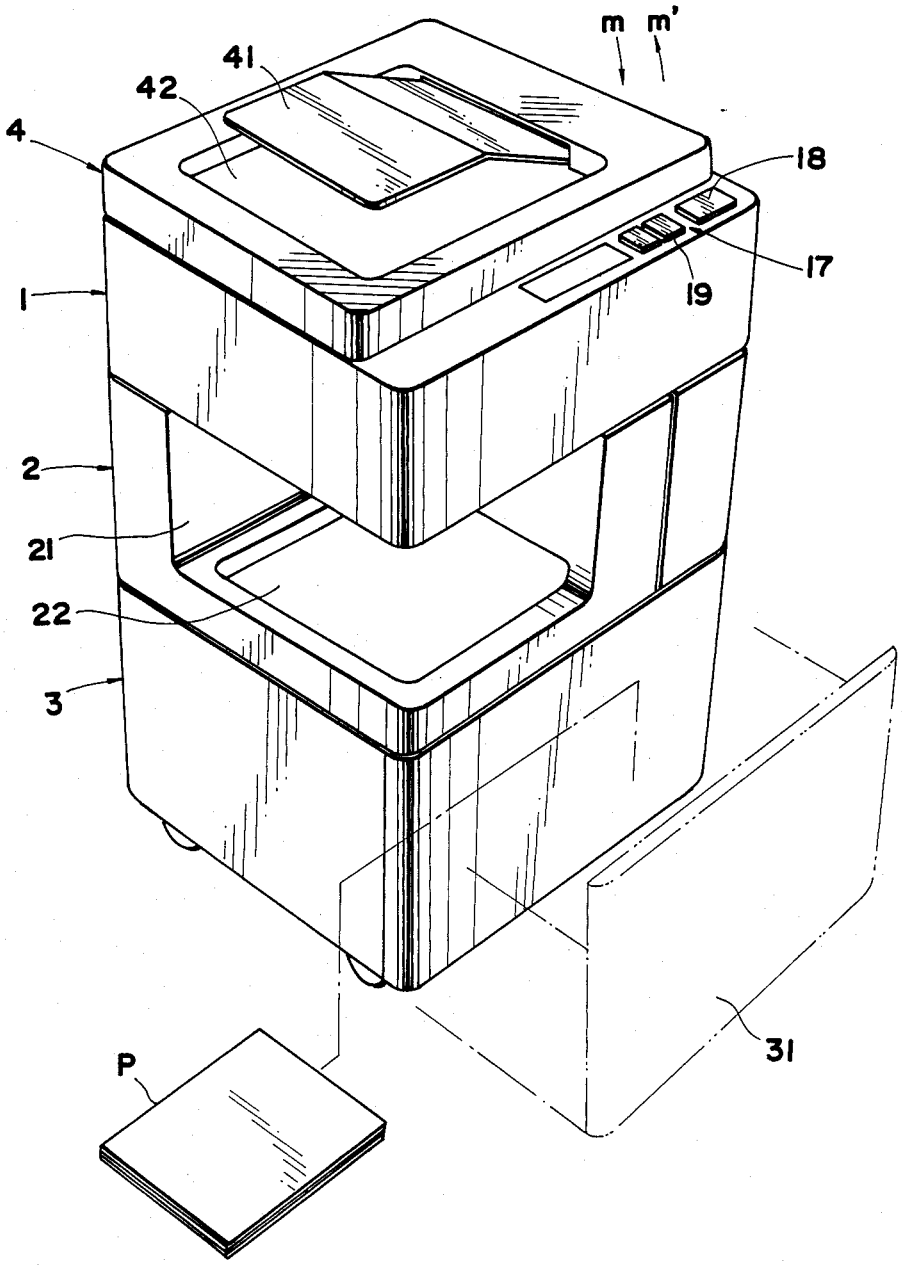
FIG. 1 is a perspective view of an electrophotocopier which is fitted with an embodiment of an inventive image forming apparatus.

In FIG. 1, showing the embodiment in its outline perspective view, the electrophotocopier comprises a machine proper 1, a paper discharge unit 2, a paper supply unit 3 and an automatic document feeder, to be briefly expressed hereinafter as ADF, 4; these units being arranged one after another from below in an overlapped manner and in the order of 3, 2, 1 and 4, as clearly shown. As may be well supposed, these units 1, 2, 3 and 4 are constituted in separate and independent units which may be separated from each other and reassembled together, as occasion may desire.

Figure 2:
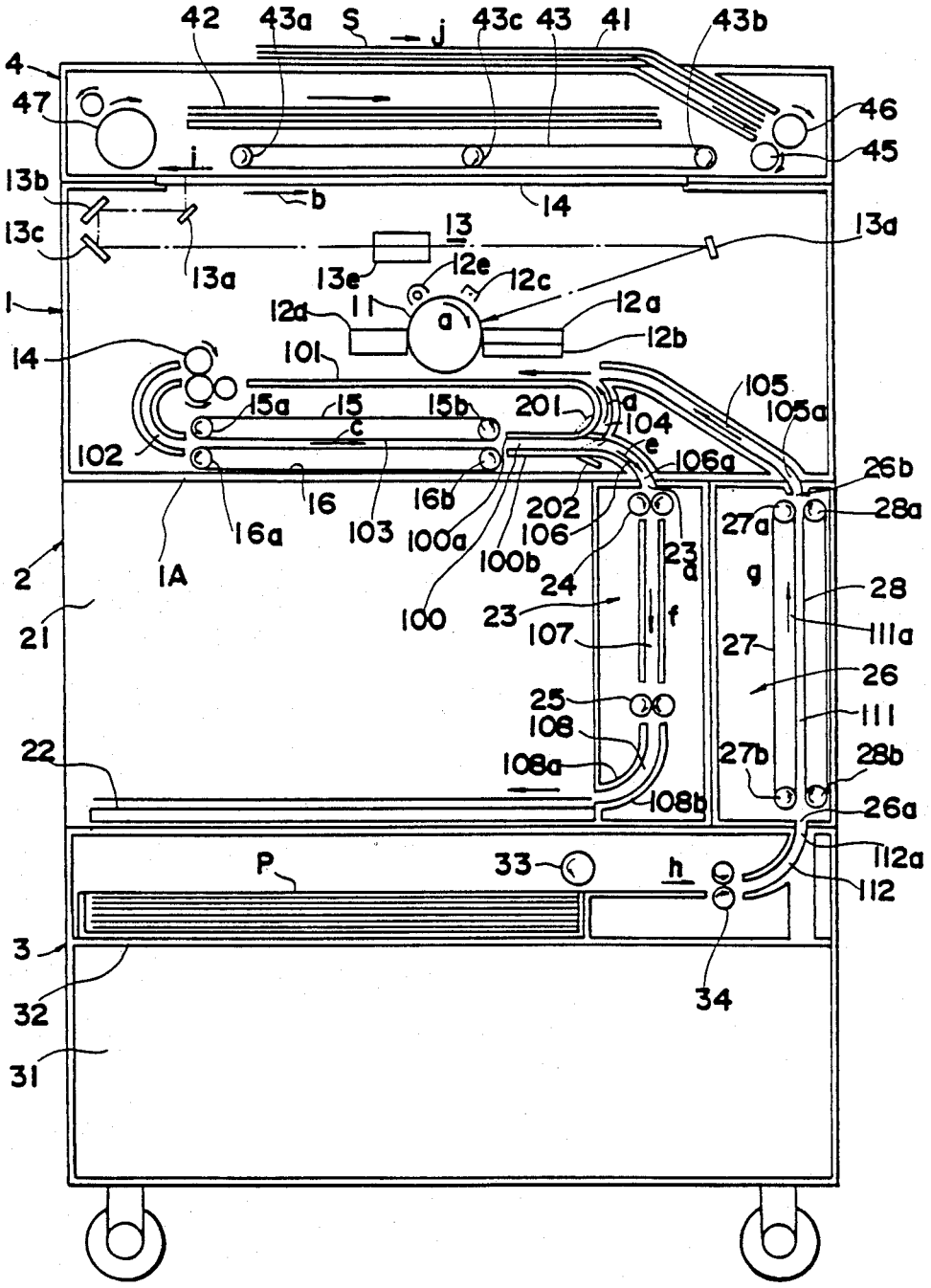
FIG. 2 is a sectional elevation view of the photocopier shown in FIG. 1.

As shown in FIG. 2, machine proper 1 of the copier comprises substantially at the center a photosensitive drum 11 which is mounted rotatably as hinted by a small arrow "a"; and several different, image forming elements such as first developing unit **12*a*, second developing unit 12*b*, static charger 12*c*, cleaner 12*d*, eraser lamp 12*e* and etc., all these being arranged around the drum for cooperation therewith in the conventional electrophotocopying process as occasion may desire. First and second developing elements 12*a*, 12*b* are so designed and arranged, as to execute developing jobs with use of respectively different color toners specifically selected. It should be noted, however, that either of these different color toners is used only optionally. Above the drum 11, there is arranged a conventional optical system 13, represented only schematically, which is so designed and arranged to project images of a document, if any, on a glass-made, document table 14 arranged above the drum 11**. The execution of an image scanning and projecting operation is in the direction shown by a small arrow "b", parallel to the document table, as is highly well known to any person skilled in the art.

The optical system 13 comprises a conventional exposure lamp, not shown, four mirrors **13*a*–13*d*; and a projector lens 13*e***.

Below the drum 11, a horizontally extending circular paper passage route comprising passage elements 101, 102, 103 and 104. The first passage element 101 is defined by a substantially horizontally extending paper guide positioned at a level directly below the drum 11 from an upstream portion of the paper feed route towards an image fixing roller pair 14. The roller pair 14 rotates in opposite and mating directions shown by respective small arrows attached thereto, for fusing toner images on a copy paper fed along the passage element 101. The second passage element 102 consists substantially of a U-turn comprising a parallel pair of U-bend strip guides for transferring the copy paper passed through said roller pair 14 towards the third passage element 103 extending substantially horizontal at a lower level below said first passage element 101.

The third passage element 103 is formed between a parallel pair of oppositely circulating belts 15 and 16 arranged at a lower level below the first passage element 101 and passing around respective remote driving roller pairs 15*a*, 15*b* and 16*a*, 16*b* which are positioned in symmetry to each other when seen vertically in FIG. 2. The belts circulates in such a way that the mutually contacting belt portions run in the common paper feed direction shown by a small arrow "c". A pair of remote and parallel extension guide plates 100*a*, 100*b* consisting in combination of an extension passage 100 are provided to extend from the output ends of both belts 15, 16 for transfer of the fed-out paper therefrom further forward.

Passage element 104 provides a return U-bend passage for connection of the outlet end of extension passage 100 with the inlet end of the first passage element 101.

At the upper and lower ends of the fourth passage element 104, first and second further passages 105 and 106 are provided. The passage 105 leads to an outlet opening 105*a* bored through the bottom plate 1A of machine proper 1, while the latter 106 leads to another outlet opening 106*a* which is equally bored through the same bottom plate 1A at a remote position from the said opening 105*a*. The upper outlet end of passage 105 is kept in communication with the main first passage 101 at the inlet end thereof, while the upper and lower ends of said second passage 106 are connected with the outlet end of extension passage 100 and another outlet opening 106*a* bored through bottom plate 1A of machine proper 1, respectively. At the paper-receiving lower end of fourth passage element 104, connected either with the outlet end of extension passage 100 or with inlet end of second passage 106 are provided change-over pawls or the like means 201, 202. The change-over pawls may be positioned optionally either at full line or dotted line positions for the execution of such change-over operation. Thus, the copy paper will be delivered from outlet end of the third passage element 103, optionally either to passage 104 or 106, by proper and selective manipulation of switch-over means 201, 202. Depending upon this switch-over operation, the copy paper can be selectively fed out from the third passage element 103, either to passage 104 or 106.

On the upper surface of machine proper 1, an operation control panel 17 is provided as shown in FIG. 1. This panel 17 comprises a print switch 18 adapted for providing print-initiation instructiôns and a copy mode selection switch 19 adapted for specifically selected the copying mode and other switching means and display means.

Paper discharge unit 2 includes a copy paper discharge section 21, referring to FIGS. 1 and 2, which represents a large free space kept in open communication with the outside environment. A paper discharge tray 22 is provided at the lower part thereof. At one side of the paper discharge section 21, there are provided a paper discharge passage 23 extending in the vertical direction from the bottom of machine proper 1 towards the tray 22 and a paper supply passage 26 extending substantially vertically from paper supply section 3 to the bottom of machine proper 1.

At the righthand portion of paper discharge section 21, there are provided the paper discharge passage 23 and the paper supply passage 26. The former passage 23 extends from an opening 23*a* formed through the upper wall of paper discharge unit 2 in correspondence with the opening 106 bored through the bottom wall of machine proper 1 to paper discharge tray 22. On the other hand, the latter passage 26 extends substantially vertically from another opening 26*a* formed through the bottom wall of paper discharge unit 2 to another opening 26*b* bored through the upper wall of the unit 2, in correspondence with the opening 105*a* bored through the bottom wall of machine proper 1, and in order to receive papers from paper supply unit 3.

Roller pair 24 is arranged in close proximity to the opening 23*a* of paper discharge passage unit 23. Further, another roller pair 25 is arranged substantially at the middle height of paper discharge passage unit 23. A paper-carrying connection between these two roller pairs 24, 25 is assured by provision of a connection passage 108 formed by and between substantially J-formed sheet bend pair 108*a*, 108*b*.

In the paper supply passage unit 26, there are two neighboring belt-drive roller pairs 27*a*, 27*b* and 28*a*, 28*b*; each pair consisting of two vertically separated rollers for driving respective conveyer belts 27, 28 which contact with each other to provide a single paper feed passage 111 formed therebetween. Two neighboring rollers 27*a*, 28*a* and 27*b*, 28*b* are arranged in close proximity to upper and lower respective openings 26*b* and 26*a*. As shown by a small arrow 111*a*, the mutually contacting portions of the belts 27, 28 constitute an upwardly directing paper feed passage with respective rotation of the rollers 27*a*, 27*b* and 28*a*, 28*b*.

Paper feed unit 3 is provided with a container box 31 so as to draw out from the unit 3 and to insert therein, as is more specifically shown in FIG. 1 in imaginary lines, for allowing push/pull manipulating operations. There is provided a paper supply tray 32 on which a paper stack P is mounted. Numeral 33 represents a paper feed roller which is above and rotatably mounted in close proximity to the outlet edge of tray 32 and so as to contact with and to separate from the paper stack P. When this roller is rotated in the direction shown by a small arrow attached thereto and brought into contact with the paper stack, the uppermost paper sheet will be delivered each time forward.

At a certain fixed forward distance from the first feed roller 33, a second feed roller pair 34 is arranged. A curved paper feed passage 112 is provided between the roller pair 34 and an opening 112*a* bored through the upper wall of paper supply unit 3, and serving as the outlet end of passage 112 and kept in registration with the paper inlet opening 26*a* formed at the bottom wall of said paper discharge unit 2.

ADF 4 is mounted on the document glass table 14 and closable as shown in full lines and reopenable, as hinted with a pair of oppositely directing small arrows m and m', respectively, in FIG. 1.

For this purpose, a hinge is provided, although not shown, at the rear portion of the machine proper 1, as seen in FIG. 1. There are upper and lower trays 41 and 42 on ADF 4, the upper one serving for document reception and the lower one 42 serving for document discharge.

An endless conveyer belt 43 is arranged below the paper discharge tray 42, and around a pair of horizontally remote drive rollers 43*a* and 43*b*, rotatable in the common direction shown in FIG. 2 by respective small arrows. An intermediate free roller 43*c* is arranged midway between drive rollers 43*a* and 43*b* and kept in frictional contact with the inside surfaces of the belting. The lower stretch of the belt is kept in pressure contact with the upper surface of the document glass table 14, when ADF 4 is kept in the closed position.

At the feeding end of paper supply tray 41, there is provided a paper feed roller 45 and a paging roller 46 which are rotatable in the same rotational direction, as is commonly well known and as shown by respective small arrows attached thereto. At a remote distance from the opposite end of belt 43 and in front of the beginning end of paper discharge tray 42, there is arranged a mutually mating small and large roller pair 47, rotatable in opposite directions for execution of paper discharge service, as shown by respective small arrows attached thereto.

The operation of the electro-photocopier of the foregoing structure and parts arrangement will now be set forth hereinunder.

Upon opening ADF 4, a document is placed on glass table 14. Then, print switch 18 is manipulated to ON, thereby an exposure lamp, not shown, of optical system 13 projects light onto the document surface, while it is moving in the direction schematically shown by an arrow "b" and the reflected light being directed through reflectors 13*a*, 13*b*, 13*c* and 13*d* and further through a lens 13*e* towards the photo-sensitive surface of drum 11 for execution of an exposure job. The thus formed latent images are processed by a first or second developer unit 12*a* or 12*b* for the formation of corresponding toner images, as is well known.

On the other hand, copy papers of the stack P held in the paper feed unit 3 will be delivered sheetwise, by rotating pressure contact with delivery roller 33, in the forward direction shown by a small arrow "h". The paper is further conveyed through rotating feed roller pair 34 and still further through the stationary guide passage 112 and registrating openings 112*a*, 26*a* into the upwardly extending conveying passage 111 between the circulating belts 27, 28 mounted in paper supply passage 26 of paper discharge unit 2.

With rotation of drive and guide rollers 27*a*, 27*b* and 28*a*, 28*b*, the copy paper is fed from the paper supply unit, or more specifically chamber 26 feeds the paper on upwardly as shown in FIG. 2 by an arrow "g" and through the conveying passage 111 formed between two neighboring circulation belts 27, 28, as well as two mutually registrating openings 26*b*, 105*a* into the interior space of machine proper 1.

The thus fed-in copy paper will travel through passage 105 to 101, the latter passage being arranged directly below the drum 1, as was referred to, in order to be transferred with the toner images formed thereon, and further conveyed through image-fixing rollers 14 for subjecting to the conventional image fixing step.

Thereafter, the image-deposited paper is further conveyed through passages 102 to 103 and conveyed in the direction of the arrow "c".

When the copy mode has been selected to be "normal", the change-over pawls 201 202 are positioned at the full-line position. Then, the paper under consideration will be conveyed through curved passage 106, as shown by an arrow "e", and further fed into paper discharge passage 23 of the unit 2.

On the contrary, and in advance of an ON-operation of print switch 18, if the composite copy mode for printing images of two different documents on the same surface of a single copy paper has been preselected, the change-over pawls will be positioned from the full-line to dotted line position. Then, the image-deposited paper will be conveyed through the passage 104 in the direction of arrow "d", for returning back to the first passage 101, so as to be transferred with the second toner images and then fed into paper discharge chamber 23 of the unit 2, as in the same manner as before, in the first image-forming operation.

The image-deposited paper fed into the paper discharge chamber 23 is further conveyed, under the action of roller pair 24, through passage way 107 downwards vertically as shown by arrow "f". Then, the paper is subjected to a conveying action by roller pair 25 and conveyed through the passage 108 and finally into the paper discharge tray 22.

It should be noted at this stage of description, if the developing unit to be used during the first and second copy-making operations is changed over in this composite copy mode from the first at 12*a* to the second developing unit at 12*b*, a twin color copy can be produced.

On the other hand, when the ADF 4 is used, the lowermost sheet of the document stack S contained in document supply tray 41 will be fed out in the direction shown by arrow "j" by the respective rotations of paper feed roller 45 and paging roller 46, which is caused by an ON-operation of print switch 18, and as shown by small arrows attached respectively thereto. When the fed out document sheet arrives at a position below the circulating belt 43, it is conveyed in the direction of arrow "i" while sliding over the upper surface of glass table 14 under the influence of frictional contact with the belt and is automatically halted at a predetermined position on the glass table.

Then, the conventional scanning exposure operation of optical system 13 is initiated, as in the previously set forth copying operations.

Upon completion of the scanning operation of optical system 13, the document will be again conveyed in the direction as shown by arrow "i", pass through paper discharge roller pair 47, and finally onto the document discharge tray 42.

Other copy-making operations are the same as in the foregoing case where ADF 4 was non-operative. Therefore, these could be omitted from the presently set forth, detailed description without sacrificing better understanding of the present invention.

Figure 3:
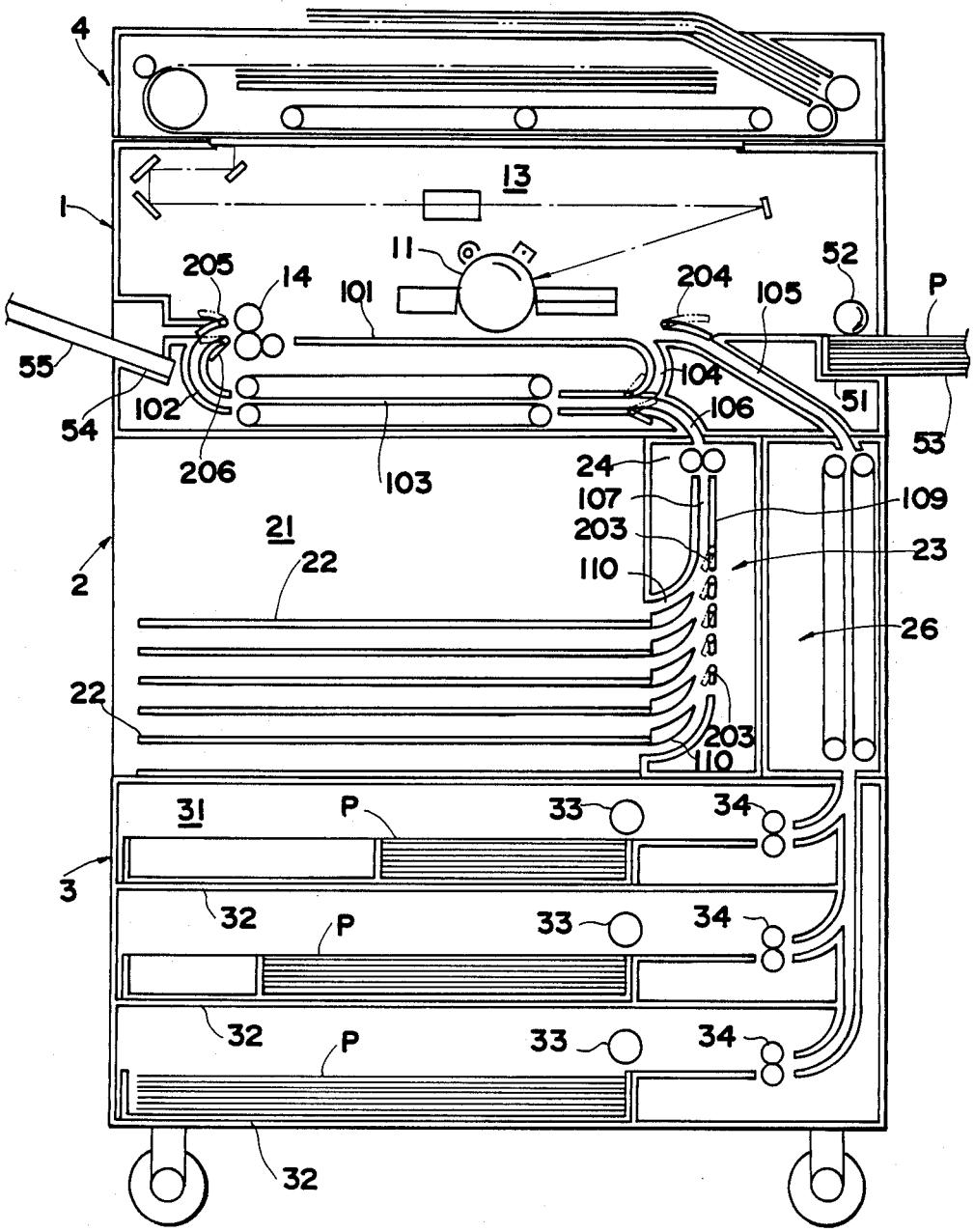
FIG. 3 is a substantially similar view to FIG. 2, showing, however, a modification of the foregoing embodiment.

Now, referring to FIG. 3, a modification of the foregoing embodiment will be set forth in detail. However, same or similar machine parts as adopted herein which have been described in the foregoing are illustrated with the same reference numerals and the structure and function thereof will be omitted herein for avoiding overlapped and superfluous description.

It should be noted that in the case of the present modification, there are additionally provided at both sides of machine proper 1, respectively, a paper feed cassette attaching portion 51 and a paper discharge tray attaching portion 54, in addition to the lowermost paper feed unit 3 and intermediate height paper discharge unit 2 which are substantially similar to those set forth in the foregoing. Above the attaching portion 51, a paper feed roller 52 is arranged which is rotatable in the direction as shown by an arrow attached thereto. A paper feed casette 53 mounting a copy paper stack, equally represented by P, and a paper discharge tray 55 are disengageably attached to said portions 51 and 54, respectively.

With rotation of paper feed roller 52, paper sheets are successively fed out from the stack P in the cassette 53 towards paper passage 101. When the copy paper is formed with images as necessary, it is discharged onto the paper discharge tray 55. In this case, either paper feed from cassette 53 or that from paper feed unit 3 may be selectively executed. For this purpose, a change over pawl 204 is provided at the most upstream portion of passage 101, so as to provide a possibility for optional connection of passage 101 either with paper supply cassette 53 or passage 105.

In the similar way, change over pawl 205 is provided at the downstream portion of fixing roller pair 14, so as to give a possibility for optional conveyance of copy paper either to paper discharge tray 55 or passage 102.

As for present paper discharge tray section 2, it should be noted that a plurality of paper discharge trays 22 are arranged in multiple stages as shown, and further that change over pawls 203 are also arranged in multiple stages along a guide plate 109 defining paper discharge passage 23 in the corresponding manner, so as to allow these pawls each to position either at a full-line or dotted line position. In this way, copy papers fed from curved passage 106 through the passage 107 may be sorted to multi-stage trays 22 through correspondingly multistaged paper guide passage 110, thereby providing a paper-sorting capability.

Further, as for paper feed section 3, it is noted that paper supply trays 32 are arranged in multiple stages therein and that respective paper supply rollers are mounted rotatable and in pressure contact with and separable from the respective paper stacks P.

These paper feed trays 32 may mount different size paper stacks P and therefore, any selected size paper stack thereof may be utilized as desired.

It will be noted that between the foregoing embodiment and the modification set forth hereinbefore, the machine proper 1, paper discharge section 2 and paper feed section 3 represent certain structural differences. However, any one thereof can be exchanged for another. Therefore, it is possible to employ any combination of the machine proper 1, paper discharge section 2 and paper feed section 3 which can be exchanged between one to another to modify these combinations.

It should be further noted that either in the embodiment or in the modification, paper supply section 3, paper discharge section 2 and machine proper 1 have been assembled together from below into one total unit. However, when aiming at substantial reduction of the occupying area by the total copier machine, the assembling mode is not limited only thereto. As a modified arrangement, as an example, the paper discharge section 2 may be arranged at the bottom of the machine and then, the paper supply section 3 and machine proper 1 may be arranged thereon. In this case, a copy paper conveying passage may be provided within the interior space of the paper supply section 3, so as to extend from machine proper 1 to paper discharge section 2 for conveying the copy paper.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a main body provided with an image forming section for forming an image on a copy paper;

a paper supply unit, positioned below said main body, for supplying the copy paper to said main body; and a paper discharge unit, positioned between said main body and said paper supply unit, including a paper tray means in communication with the exterior of the apparatus for receiving the copy paper with the image formed thereon;

wherein said main body, said paper supply unit and said paper discharge unit, each of which has a generally box-shape, are vertically arranged in an overlapped relationship, and the paper discharge unit includes;

a first conveyer means for vertically transporting the copy paper from said paper supply unit to said main body, and a second conveyer means for vertically transporting the copy paper from said main body to said paper tray means.

2. An image forming apparatus as claimed in claim 1, further comprising an automatic document feeder arranged at the upper surface of said main body for automatically feeding a document.

3. An image forming apparatus as claimed in claim 1, wherein said paper discharge unit has a plurality of paper trays for receiving and sorting the copy papers thereon.

4. An image forming apparatus as claimed in claim 3, wherein said second conveyer means has paper guide passages corresponding to said paper trays for selectively delivering the copy papers to any one of the paper trays.

5. An image forming apparatus as claimed in claim 1, wherein said paper supply means has a plurality of paper storing portions for storing the copy papers with diferent sizes.

6. An image forming apparatus as claimed in claim 1, wherein said main body, said paper supply unit and said paper discharge unit are detachable from each other.

7. An image forming apparatus comprising:

a first box-shaped unit having an image forming section for forming an image on a copy paper;

a second box-shaped unit, positioned below said first unit, for supplying the copy paper to the first unit; and a third box-shaped unit, positioned between said first and second units, including a paper tray in communication with the outside environment for receiving the copy paper formed with the image thereon, a first paper passage for vertically transporting the copy paper from said second unit to said first unit and a second paper passage for vertically transporting the copy paper from said first unit to said paper tray, wherein said first, second and third units are vertically arranged in an overlapped relationship.

8. An image forming apparatus as claimed in claim 7, wherein said third unit includes a plurality of paper trays for receiving and sorting the copy papers.

9. An image forming apparatus as claimed in claim 8, wherein said second paper passage includes paper guide passages corresponding to said paper trays for selectively delivering the copy papers to any one of the paper trays.

10. An image forming apparatus as claimed in claim 7, wherein said second unit includes a plurality of paper storing portions for storing different size copy papers.

11. An image forming apparatus as claimed in claim 7, wherein said first, second and third units are detachable from each other.

* * * * *